US008403025B2

(12) United States Patent
Boivin et al.

(10) Patent No.: US 8,403,025 B2
(45) Date of Patent: Mar. 26, 2013

(54) PREPARATION OF INORGANIC SAMPLES BY FUSION

(75) Inventors: Marc Boivin, Wendake (CA); Alain Chantal, St. Nicholas (CA); Pierre-Emmanuel LeMay, Quebec (CA); Luc Saint-Pierre, Quebec (CA)

(73) Assignee: SPEX Sample Prep LLC, Metuchen, NJ (US)

( * ) Notice: Subject to any disclaimer, the term of this patent is extended or adjusted under 35 U.S.C. 154(b) by 0 days.

(21) Appl. No.: 13/220,904

(22) Filed: Aug. 30, 2011

(65) Prior Publication Data

US 2013/0049247 A1 Feb. 28, 2013

(51) Int. Cl.
*B22D 23/00* (2006.01)

(52) U.S. Cl. ..... 164/47; 164/66.1

(58) Field of Classification Search ..... 164/6, 47, 164/66.1

See application file for complete search history.

(56) References Cited

U.S. PATENT DOCUMENTS 4,865,784 A * 9/1989 Hill ..... 264/45.3

OTHER PUBLICATIONS

International Search Report and Written Opinion, dated Nov. 20, 2012 of International Application No. PCT/US12/52783, dated Aug. 29, 2012.

* cited by examiner

*Primary Examiner* — Kevin P Kerns
(74) *Attorney, Agent, or Firm* — Kaplan Breyer Schwarz & Ottesen, LLP

(57) ABSTRACT

In a process for the preparation of inorganic sample disks for analysis, the sample, in powdered form, is mixed with a powdered reagent flux which has been pre-melted. In an inert gas atmosphere, the mixture is placed in a graphite crucible and heated to a temperature slightly above 1000° C. After the flux dissolves the sample, a homogenous mix is produced. This mix is then poured into a graphite mold, the bottom of which contains a molten pool of an inert metal, such as gold, which acts as a smooth receiving surface. Upon cooling, the material in the mold solidifies, resulting in a glassy disk that can be analyzed. Cooling can be accelerated by making use of a cooling fluid that has a substantially higher thermal capacity than air.

28 Claims, 1 Drawing Sheet

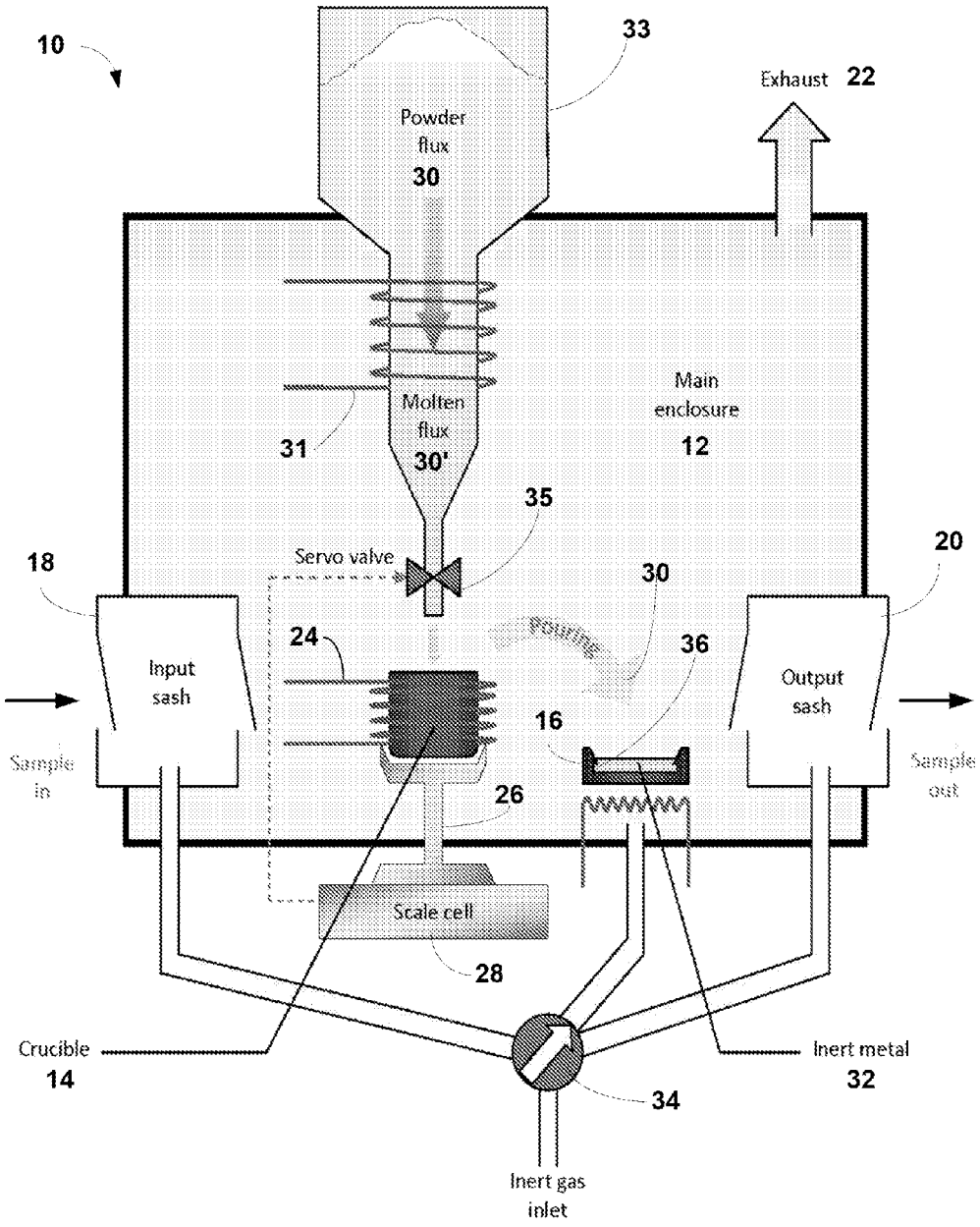
10
33
Exhaust 22
Powder flux 30
Main enclosure 12
Molten flux 30'
31
35
Servo valve
18
20
30
Pouring
24
36
Input sash
Output sash
16
Sample in
Sample out
26
Scale cell
28
Crucible 14
Inert metal 32
34
Inert gas inlet

PREPARATION OF INORGANIC SAMPLES BY FUSION

BACKGROUND OF THE INVENTION

The present invention relates generally to the preparation of inorganic samples by fusion and, more particularly, concerns an improved method and system for the preparation of inorganic samples by fusion.

In a known, existing process for the preparation of inorganic samples for analysis, the sample (geological, mineralogical or some inorganic material) in powdered form is mixed with a powdered reagent called a flux. The mixture is placed in a platinum-gold alloy crucible, and heated to a temperature slightly above 1000° C. At such temperatures, the flux will melt in a few minutes and dissolve the oxides present in the sample, producing a homogenous mix. This molten mix is then poured into a mold made of the same alloy as the crucible. Upon cooling, the material in the mold will solidify, resulting in a glassy disk that can be analyzed.

This process exhibits at least the following shortcomings:

- In some instances this procedure can take an inordinately long time;
- The cost of the crucibles and molds is very high, these items being made of precious metals;
- With some samples, the molten material is very sticky, and causes the glassy disk to crack;
- The melt stickiness can also cause fast mold degradation;
- The surface of the mold must be as perfectly flat and as smooth as possible or analytical errors will appear;
- Re-polishing of the mold surface is needed to maintain this smoothness;
- Samples containing platinum or gold (or other precious metals) cannot be prepared, due to the risk of amalgamation with the crucible.

Broadly, it is an object of the present invention to provide a method and system for the preparation of inorganic samples, which overcome one or more of the shortcomings of the existing process. It is specifically contemplated that the method and system should be convenient and reliable in use, and preferably should realize cost savings in comparison with the existing process.

In accordance with one aspect of the invention, a smooth receiving surface for the mix is ensured and the amount of surface re-polishing minimized by pouring the homogenous mix on an inert, molten metal surface, such as liquid gold.

In accordance with another aspect of the invention, the speed of the process is improved by pre-melting the flux in a heating chamber and mixing it with the sample in a liquid state. It is also contemplated that the speed of the process can be increased by cooling the glassy disk with a fluid that has a substantially higher thermal capacity than air, which is normally used for cooling. Preferred fluids include water and liquefied gases, which are very cold when depressurized from their stored form to atmospheric pressure.

In accordance with another aspect of the present invention, savings can be realized by eliminating crucibles made of precious metals (e.g. a platinum-gold alloy, hereafter also referred to as "platinumware") and replacing them with crucibles made of a glassy graphite (hereafter also referred to as "graphiteware"). However, inasmuch as graphite degrades quickly at high temperatures in the presence of oxygen, the process must be performed in an inert gas ambient atmosphere, preferably one containing nitrogen, argon, or neon, or combinations thereof

BRIEF DESCRIPTION OF THE DRAWING

The foregoing brief description and further objects, features, and advantages of the present invention will be understood more completely from the following detailed description of a presently preferred, but nonetheless illustrative, embodiment in accordance with the present invention, with reference being had to the accompanying drawings in which FIG. 1, the only figure, is a schematic diagram of a system for the preparation of inorganic samples by fusion which embodies the present invention.

DETAILED DESCRIPTION

The preparation of inorganic samples by fusion in accordance with the present invention involves the heating of a crucible containing a mixture of lithium borate flux and the sample itself, finely ground. Very often, laboratory personnel performing the process will also add a halogen chemical compound to facilitate the removal of the end-product. The lithium borate dissolves the sample, and this dissolution can be enhanced by the agitation of the crucible. After complete reaction, the resulting hot solution is poured into a plate-shaped mold and cooled, to produce a glassy disk that can then be used conveniently in an elemental analyzer.

FIG. 1 is a schematic diagram of a system 10 for the preparation of inorganic samples by fusion which embodies the present invention. All processes are performed within a main enclosure 12 which is preferably airtight. Enclosure 12 is continuously filled from below with an inert gas, such as nitrogen, argon or neon, the gas being selected to inhibit oxidation and other reactions, even at very high temperatures. The primary purpose of the gas is to prevent oxidation of the components inside the enclosure, such as a crucible 14 and mold 16, discussed further below.

Fresh inert gas is piped into an input sash 18 and an output sash 20, which are used, respectively, to insert samples into and withdraw completed samples from enclosure 12. In order to minimize the loss of gas, sashes 18 and 20 are designed with doors that allow gas flow into the main enclosure 12, but not out of it. Any excess gas that accumulates in main enclosure 12 exits via an exhaust 22 at the top of enclosure 12, preferably into an existing fume hood piping system (not shown).

A sample is fed into enclosure 12 through the input sash 18 and retained in crucible 14, which is made of graphite. Crucibles for this type of process are most often made of a platinum-gold alloy, which is quite expensive, and the use of a graphite crucible realizes considerable savings. The use of an inert gas atmosphere makes a graphite crucible an effective replacement by avoiding the deterioration of the crucible which would occur inside enclosure 12 in the presence of oxygen, since process temperatures exceed 1000° C. Crucible 14 is heated by means of a heater 24, and it sits directly on a mechanical support 26, which, in turn, sits upon an electronic scale (and system controller) 28, which is located outside enclosure 12, to ensure temperature measurement stability. Scale 28 senses the mass of the sample and the system controller calculates the mass of flux to be added.

Powdered flux 30 is stored in a hopper 33 above the enclosure 12. A heater 31 in the lower portion of hopper 33 melts the flux to a liquid state. The addition of molten flux to crucible 14 is regulated by means of a servo valve 35, which is controlled by controller 28. As a result, a precisely correct amount of flux can be added to the sample within the crucible. Dissolution of the sample into the flux occurs in the presence of heat provided by heater 24. By adding molten flux to the crucible, rather than powdered flux as is common with the existing process, it is possible to accelerate the dissolution of the sample Once the sample is completely dissolved, it is poured into the mold 16 by tilting crucible 14, as indicated by the arrow pointing downward from powder flux 30.

The mold assembly 16 comprises a rigid case containing a re-meltable material 32, such as gold. This material must be denser than molten flux 30', must be inert to the material, must have a melting point below 1200° C., and must not adhere to flux. The gold is melted while the sample is still in the crucible, thus forming a smooth receiving surface. Upon pouring, the flux floats upon the molten gold. Mold 16 is then cooled by operating a valve 34 to inject inert gas under mold 16, forming a glassy disk on top of the gold. The base of mold 16 is a plain, polished surface, while its upper portion is hollowed out with a conical wall to allow easy removal of the disk.

The lower portion of mold 16 contains an undercut groove portion 36 to retain the gold inside the mold. That is, when the glassy disk is removed, the solidified gold is held in place at the bottom of the crucible by the solidified gold forming toward the bottom of the crucible as shown, which holds the gold in place and allows only the glassy disk to be removed.

Pouring the dissolved sample onto an inert molten metal receiving surface assures that the sample will always be on a perfectly flat, smooth surface that will not require constant re-polishing.

In order to accelerate the process, it is contemplated that, instead of cooling the mold with the inert gas, it could be cooled, instead, by introducing a fluid that has a substantially higher thermal capacity. Preferred fluids include water and liquefied gases, which are very cold when depressurized from their stored form to atmospheric pressure.

Although preferred embodiments of the invention have been disclosed for illustrative purposes, those skilled in the will appreciate that many additions, modifications, and substitutions are possible without departing from the scope and spirit of the invention as defined by the accompanying claims.

What is claimed:

1. A process for the manufacture of sample disks from a powdered inorganic sample, comprising the steps of:

combining a powdered reagent with the sample in a crucible;

heating the crucible to obtain a mix in which the sample is dissolved;

pouring the mix into a mold containing a molten metal as a receiving bottom surface for the mix, the molten metal being denser than the mix, being substantially inert to the mix and not adherent thereto and having a melting point below 1200° C.; and cooling the mix while in the mold in order to form a disk.

2. The process of claim 1 performed with a mold having an inner bottom wall and an inner periphery which is undercut in the vicinity of the bottom wall so that the interior of the mold has an increased lateral dimension in the vicinity of the bottom wall.

3. The process of claim 1 wherein the metal is gold or a gold alloy.

4. The process of claim 3 wherein the reagent is melted prior to the combining step.

5. The process of claim 4 wherein the cooling step includes introducing a fluid that has a substantially higher thermal capacity than air.

6. The process of claim 5 wherein the fluid is one of water or liquefied which is depressurized upon introduction.

7. The process of claim 5 wherein the crucible and mold are made of graphite, the process being performed in an atmosphere consisting essentially of an inert gas.

8. The process of claim 7 wherein the inert gas is a member of the noble gases group.

9. The process of claim 1 wherein the reagent is melted prior to the combining step.

10. The process of claim 1 wherein the cooling step includes introducing a fluid that has a substantially higher thermal capacity than air.

11. The process of claim 1 wherein the crucible and mold are made of graphite, the process being performed in an atmosphere consisting essentially of an inert gas.

12. The process of claim 11 wherein the inert gas includes a member of the group containing nitrogen, argon, and neon.

13. A process for the manufacture of sample disks from a powdered inorganic sample, comprising the steps of:

combining a melted, powdered reagent with the sample in a crucible;

heating the crucible to obtain a mix in which the sample is dissolved;

pouring the mix into a mold containing a molten metal as a receiving bottom surface for the mix; and cooling the mix while in the mold in order to form a disk.

14. The process of claim 13 wherein the cooling step includes introducing a fluid that has a substantially higher thermal capacity than air.

15. The process of claim 14 wherein the fluid is one of water and liquefied which is depressurized upon introduction.

16. The process of claim 14 wherein the crucible and mold are made of graphite, the process being performed in an atmosphere consisting essentially of an inert gas.

17. The process of claim 16 wherein the inert gas includes a member of the group containing nitrogen, argon, and neon.

18. The process of claim 13 wherein the crucible and mold are made of graphite, the process being performed in an atmosphere consisting essentially of an inert gas.

19. The process of claim 18 wherein the inert gas includes a member of the group containing nitrogen, argon, and neon.

20. A process for the manufacture of sample disks from a powdered inorganic sample, comprising the steps of:

combining a powdered reagent with the sample in a crucible;

heating the crucible to obtain a mix in which the sample is dissolved;

pouring the mix into a mold containing a molten metal as a receiving bottom surface for the mix; and cooling the mix while in the mold by introducing a fluid that has a substantially higher thermal capacity than air, thereby forming a disk.

21. The process of claim 20 wherein the fluid is one of water and liquefied which is depressurized upon introduction.

22. The process of claim 20 wherein the reagent is melted prior to the combining step.

23. The process of claim 20 wherein the crucible and mold are made of graphite, the process being performed in an atmosphere consisting essentially of an inert gas.

24. The process of claim 23 wherein the inert gas includes a member of the group containing nitrogen, argon, and neon.

25. A process for the manufacture of sample disks from a powdered inorganic sample, comprising the steps of:

combining a powdered reagent with the sample in a crucible made of graphite;

heating the crucible to obtain a mix in which the sample is dissolved;

pouring the mix into a mold made of graphite, the mold containing a molten metal as a receiving bottom surface for the mix; and cooling the mix while in the mold in order to form a disk;

the process being performed in an atmosphere consisting essentially of an inert gas and the mold having its bottom coated with a metal.

26. The process of claim 25 wherein the inert gas includes a member of the group containing nitrogen, argon, and neon.

27. The process of claim 25 wherein the reagent is melted prior to the combining step.

28. The process of claim 25 wherein the cooling step includes introducing a fluid that has a substantially higher thermal capacity than air.

* * * * *